US012486656B1

(12) United States Patent
Warren et al.

(10) Patent No.: US 12,486,656 B1
(45) Date of Patent: Dec. 2, 2025

(54) MANHOLE COVER SEAL

(71) Applicant: Danny Warren Consulting, LLC, Carver, MA (US)

(72) Inventors: Danny Warren, Carver, MA (US); Scott Kraihanzel, Barnstable, MA (US)

( * ) Notice: Subject to any disclaimer, the term of this patent is extended or adjusted under 35 U.S.C. 154(b) by 0 days.

(21) Appl. No.: 18/732,679

(22) Filed: Jun. 4, 2024

(51) Int. Cl.
*E03F 5/02* (2006.01)

(52) U.S. Cl.
CPC ..... *E03F 5/024* (2013.01); *E03F 2005/028* (2013.01)

(58) Field of Classification Search
CPC ..... E03F 2005/028; E03F 5/024; F16J 15/46
See application file for complete search history.

(56) References Cited

U.S. PATENT DOCUMENTS 4,482,076 A * 11/1984 Wentzell ..... G21C 13/028 277/921
6,887,012 B1 * 5/2005 Zappe ..... E02D 29/14 404/25
7,153,057 B1 * 12/2006 Lucas ..... E02D 29/14 404/25

FOREIGN PATENT DOCUMENTS

JP 3466483 B2 * 11/2003

OTHER PUBLICATIONS

Machine Translation of JP3466483B2 (Year: 2003).*

* cited by examiner

*Primary Examiner* — Gilbert Y Lee

(57) ABSTRACT

A manhole sealing device to prevent environmental water from entering a manhole through the joint between the manhole casing, manhole cover, and cover frame. The device comprises a disc shaped inflatable seal for insertion into the upper portion of the manhole and inflated to provide a sealing means to prevent infiltration of water from the environment to the interior of the manhole. The disc shaped seal may include a first rigid stabilization portion surrounded by a flexible inflatable seal wherein the stabilization portion supports and assists in maintaining a seal to prevent water or other fluids from entering the manhole through the cover or the corbel joint thereof. The manhole sealing device can be installed in an existing manhole without replacing any of the structural parts thereof.

9 Claims, 5 Drawing Sheets

MANHOLE COVER SEAL

BACKGROUND OF THE INVENTION

The present disclosure relates to a manhole cover seal for preventing water infiltration to an underground room or tunnel which contains a utility conduit or sewer pipe. More specifically, the present disclosure relates to a manhole cover seal that is inflated to seal the manhole against infiltration of fluids while also being easily removed and reinstalled when access to the manhole is required.

It has been common practice in municipalities to install a single network of sewers to convey sewage and storm runoff to a central point for treatment and disposal. The difficulty in the combination system that carry both storm and sanitary runoff is that these sewers flood the sewage treatment plant every time it rains, and the sewage is not adequately treated, storm water is not carried off at an adequate rate, or both occur.

In many urban areas, the increased construction in buildings, streets, and parking lots has significantly decreased the ground surface area which is available for absorbing moisture from rain or snow. Accordingly, this water must be drained off and disposed of through suitable means. In some instances, it is possible to simply collect this water and discharge it into a city's sanitary sewer system. However, sewer systems must be sized such that they can accommodate the maximum influent which can be expected at any time. Accordingly, in those areas receiving a substantial amount of rain, the sewage treatment plant must be increased in size dramatically which results in exceptionally high costs. Thus, it is often advantageous to separately collect and dispose of storm water apart from the sanitary sewer system. This is often done through separate storm sewers.

During rainy weather, an average manhole in a sanitary sewer system can contribute from 3,000 to 12,000 gallons per day of rainwater to the treatment system. Accordingly, the industry has recently started separating storm runoff system from the sanitary sewer systems. However, even after separation, infiltration of environmental water into the sanitary sewer systems can still tax the capacity or the sanitary system or prevent expansion through the addition of additional sanitary connections. As a result, there is a need for a means of preventing storm runoff from entering sanitary sewer systems.

One entry point where storm water infiltrates into a sanitary sewer is through the manholes that provide access to the sanitary sewer. A typical manhole includes an underground masonry casing, a cover frame resting on the top of the casing at a corbel joint and protruding through the pavement of a street or the like, and a manhole cover received in the cover frame that is removable or hinged to allow access to the manhole. The difficulty arises in that each of these joints is difficult to seal, providing numerous opportunities for water infiltration. As a result, it is important to seal these manholes to prevent such infiltration which can add significantly to the normally calculated flow thereby increasing the volume of waste water that must be processed by the system. The prior art has realized this need to provide a seal between the cover and cover frame of a manhole by providing manhole covers which are impervious to storm water. But water can also enter the manhole through the corbel joint between the casing and cover frame of the manhole, either by seeping along the outside of the cover frame from the surface or by flowing as subsurface water under the pavement and through the corbel joint.

This joint is difficult to seal. First, iron and masonry parts interface at the corbel joint, and each has a different thermal coefficient of expansion, causing relative movement between the cover frame and casing at the corbel joint as the ambient temperature changes. Second, the casing moves relative to the cover frame each time a heavy vehicle passes near or over the manhole. Finally, the manhole cover frame frequently needs to be lifted when a road is repaved or when the manhole cover frame has settled into an existing pavement. When the manhole is raised, the cover frame and manhole casing can become separated, or an additional joint is formed between them. The prior art has not addressed the problem of sealing the entire top cover assembly of the manhole.

Another problem with some manhole sealing means known to the prior art is the need to replace existing manhole covers, the cover frames, or other parts of a manhole to seal the manhole against entry of water. Since many areas already have a great number of manholes, the need to replace parts of a manhole assembly before they wear out or are broken can exact a great financial burden on the government responsible for sealing the manhole.

Finally, while there exist prior art manhole sealing means, these solutions raise the manhole cover above pavement level, causing damage to the manhole when vehicles strike the raised manhole cover, and making the real surface uneven.

In view of the foregoing, there is a need for a device to provide a serviceable sealed cover for manholes. A primary objective of the present disclosure is the provision of a system for safely and economically sealing manholes against fluid infiltration. A further objective of the present disclosure is the provision of a system that can be easily installed and provide a seal against infiltration without the replacement of the existing manhole cover system. Still a further objective of the present disclosure is the provision of a manhole sealing system that can be removed for service and then easily replaced by service crews without the need for additional equipment or tools. These and other objectives will become apparent from the following description of the invention.

SUMMARY OF THE DISCLOSURE

In accordance with the present disclosure, a watertight manhole sealing insert is provided for preventing rainwater from entering a sewer system through a manhole cover. In one embodiment, the insert includes a dish-shaped body member with an outwardly extending flange designed to engage with an inflatable bladder seal having a fully inflated diameter that corresponds approximately to the diameter of the access port of the manhole to be sealed. The seal is positioned with the bladder in a deflated state to allow its positioning and the opening and the bladder is inflated with air pressure causing it to expand to seal the manhole opening and serving to retain the seal in its installed position. In the preferred embodiment, the body is depressed about five to six inches below the plane defined by the manhole cover. The dish shape of body limits the amount of water which can be accumulated on top of the insert to minimize the weight which it must support.

A recess is formed in the bottom of the body portion in which a valve is located. The valve is designed to release retained water from the body when the manhole needs to be accessed. The valve can be opened to allow accumulated residual water to be drained from the body into the manhole thereby allowing the seal to be drained and removed for servicing of the manhole.

In a preferred embodiment, at least one rib is provided in the rim of the body portion for stiffening and strengthening purposes as well as to receive and retain an inflatable rubber seal that is secured to the rim by glue or ultrasonic weld. It may further include downwardly-extending ribs for engaging a manhole ledge or shoulder built into the manhole.

In some embodiments, a lift strap may also be riveted or connected at both ends to the body portion, in order to facilitate easy removal of the insert from the manhole.

A sealing means, such as a tube or bladder of rubber or closed cell neoprene, is positioned on or in the rim of the body portion such that, when inflated, the sealing means forms an essentially watertight seal between the insert and the manhole frame to prevent water from seeping down around the edges.

In some embodiments, the manhole sealing insert may be entirely inflatable. In such cases, the entire insert may be formed as an inflatable bladder with stiffening regions formed in a top, bottom or, both surfaces thereof to assist the manhole sealing insert in maintaining its shape.

In all embodiments, around the periphery of the manhole sealing insert is shown an inflatable rubber seal. The inflatable seal is affixed to the edge of the manhole sealing insert. When air pressure is applied, the seal inflates to engage with the wall of the manhole structure. The seal contours to the shape of the manhole wall to create a reliable seal as well as exerting pressure against the wall to assist in retaining the sealing insert in the installed location.

Therefore, it is an object of the present disclosure to provide a manhole sealing insert that allows easy and reliable installation in an active manhole access port. It is a further object of the present disclosure to provide a manhole sealing insert that can easily be handled to facilitate installation in space restricted environments. It is still a further object of the present disclosure to provide a manhole sealing insert that can be easily serviced on sit allowing installation and removal to facilitate the servicing of the system and reinstallation for a reliable seal against water infiltration.

BRIEF DESCRIPTION OF THE DRAWINGS

In the drawings which illustrate the best mode presently contemplated for carrying out the present invention.

DETAILED DESCRIPTION OF THE INVENTION

Disclosed herein is a watertight manhole sealing insert is provided for preventing rainwater from entering a sewer system through a manhole cover. In one embodiment, the insert includes a dish-shaped body member with an outwardly extending flange designed to engage with an inflatable bladder seal having a fully inflated diameter that corresponds approximately to the diameter of the access port of the manhole to be sealed. The seal is positioned with the bladder in a deflated state to allow its positioning and the opening and the bladder is inflated with air pressure causing it to expand to seal the manhole opening and serving to retain the seal in its installed position. In the preferred embodiment, the body is depressed about five to six inches below the plane defined by the manhole cover. The body limits the amount of water which can be accumulated on top of the insert to minimize the weight which it must support.

Figure 1:
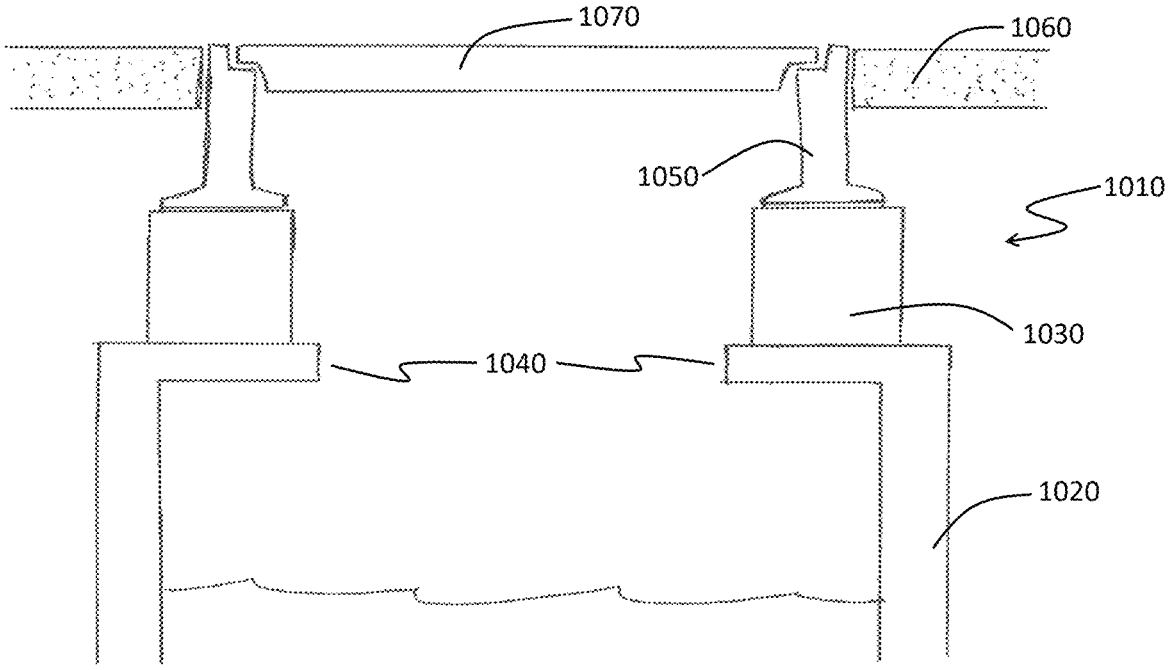
FIG. 1 (Prior Art)
FIG. 1 is a cross sectional view of a manhole assembly as known in the art.

Turning to FIG. 1, a manhole structure as typically found in the art is shown and illustrated. The manhole assembly 1010 includes an underground masonry casing 1020, a chimney 1030 extending up from the casing 1020 about a top opening 1040 therein, and a cover frame 1050 resting on the top of the chimney 1030 at a corbel joint and protruding through the pavement 1060 of a street or the like. A manhole cover 1070 is received in the cover frame 1050 that is removable or hinged to allow access to the manhole. The difficulty arises in that each of these joints is difficult to seal, providing numerous opportunities for water infiltration. As a result, it is important to seal these manholes to prevent such infiltration which can add significantly to the normally calculated flow thereby increasing the volume of waste water that must be processed by the system.

Figure 2:
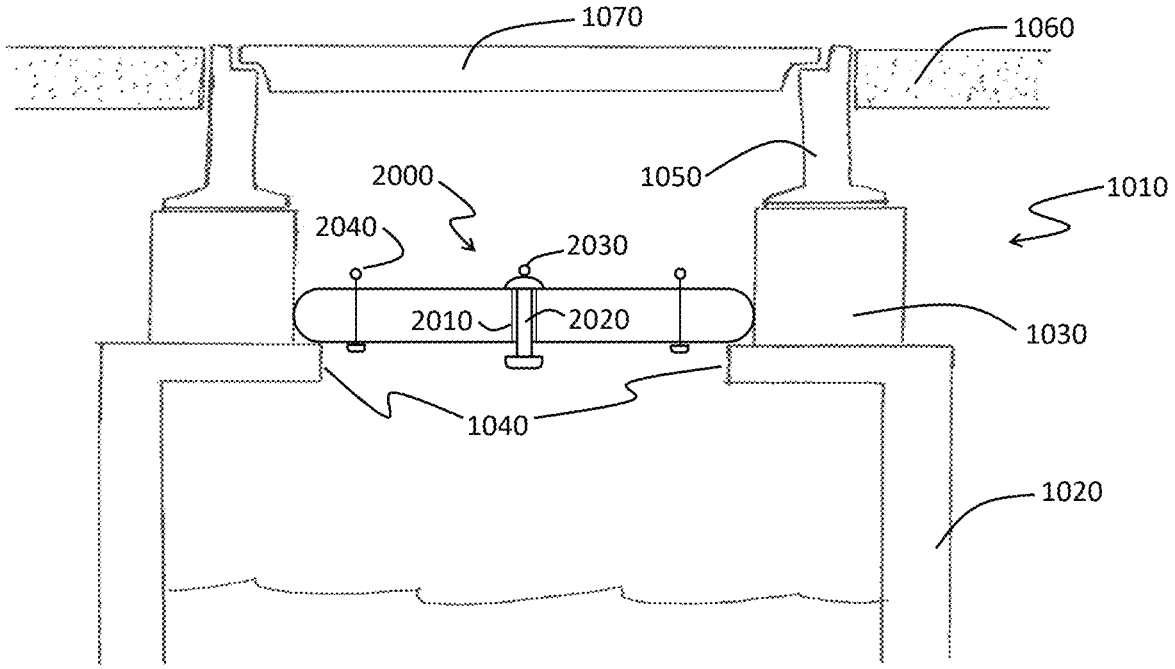
FIG. 2 is a cross sectional view of one illustrative embodiment of a manhole sealing insert in accordance with the teachings of the present disclosure.

Turning now to FIG. 2, the present disclosure provides for a manhole sealing insert 2000 that is sized and shaped to fit into a manhole access port that rests on the lip of the masonry casing 1020 as shown or on the base of the cover frame 1050. The manhole sealing insert 2000 has an inflatable feature that will be described in more detail below that allows inflation thereof causing it to expand and seal against the chimney 1030 walls or the cover frame walls 1050 thereby preventing water infiltration into the manhole. A drain opening 2010 is positioned within the manhole sealing insert 2000 with a plug 2020 positioned therein. The plug 2020 is gravity biased in a downward fashion to seal the drain opening 2010 and includes a lifting ring 2030 at the top thereof to allow the drain plug 202 to be lifted and any standing water on the top of the manhole sealing insert 2000 to be drained into the manhole when the manhole sealing insert 2000 must be removed for service. Further, lifting straps 2040 may also be provided to allow attachment of a hoist to assist in removing the manhole sealing insert 2000 from the manhole for servicing.

Figure 3:
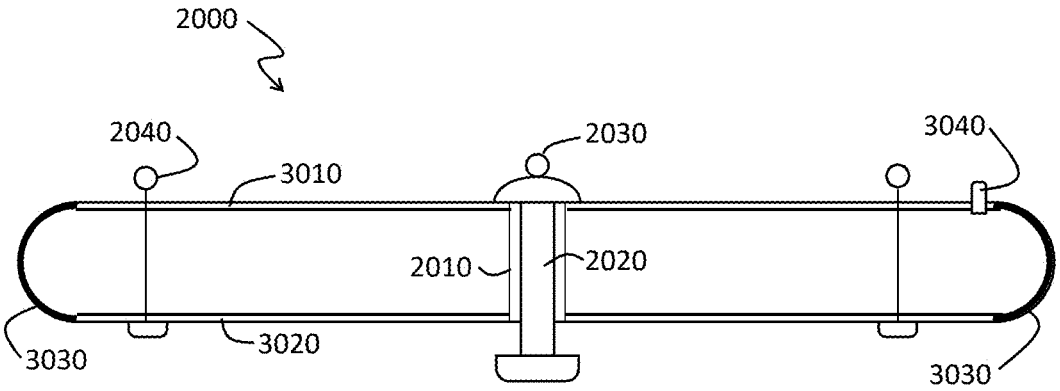
FIG. 3 is a cross sectional view of another illustrative embodiment of a manhole sealing insert in accordance with the teachings of the present disclosure.

Turning to FIG. 3, the manhole sealing insert 2000 in one embodiment is formed as a hollow body with rigid top shell 3010 and bottom shell 3020 with an inflatable seal 3030 at the opposite ends thereof. A fill valve 3040 provides a valved stem to which a source of compressed air is connected. When air pressure is applied to the fill valve 3040, the pressure on the interior of the manhole sealing insert 2000 increases causing expansion of the inflatable seals 3030 to expand against the manhole structure to form an effective water tight seal therein. In some embodiments, inflation may be done with any variety of compressed gasses including but not limited to nitrogen. Further, in some embodiments, inflation may be done using a gel or foam material. For removal, the fill valve 3040 can be opened to allow a release of the internal pressure causing the inflatable seal 3030 to shrink so that the manhole sealing insert can be removed.

Figure 4:
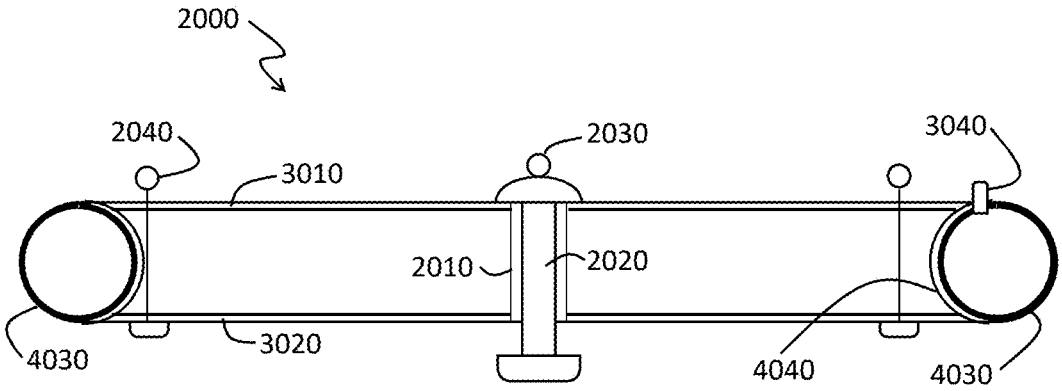
FIG. 4 is a cross sectional view of still another illustrative embodiment of a manhole sealing insert in accordance with the teachings of the present disclosure.

In some embodiments, as shown at FIG. 4, the shells 3010 and 3020 of the manhole sealing insert 2000 may be joined at their periphery by a rim structure 4040, wherein the inflatable seal 4030 is a tube that extends around the perimeter of the manhole sealing insert 2000 such that the inflatable seal 4030 is received and retained in the rim structure 4040. In a preferred embodiment, shown at FIG. 5, at least one rib 5040 may also be provided in the rim of the body portion for stiffening and strengthening purposes as well as to receive and retain the inflatable seal. The inflatable seal may be secured to the rim by glue or ultrasonic weld. It may further include downwardly-extending ribs for engaging or resting on the manhole structure.

Figure 5:
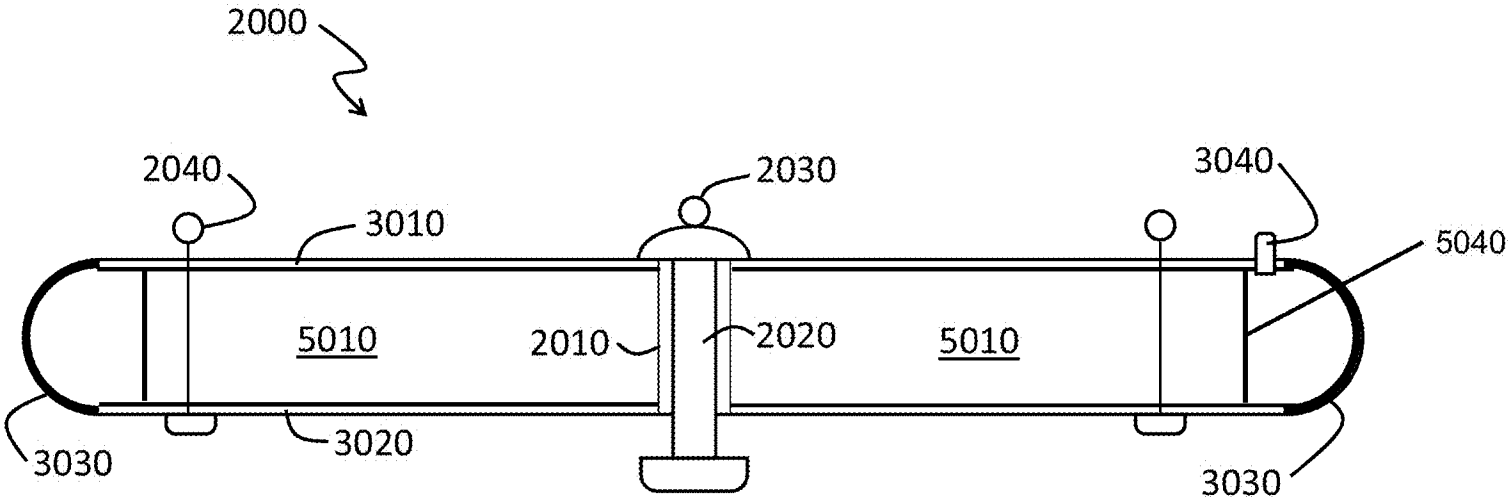
FIG. 5 is a cross sectional view of yet another illustrative embodiment of a manhole sealing insert in accordance with the teachings of the present disclosure.

In other embodiments depicted at FIG. 5, the manhole sealing insert 2000 may have an expandable solid foam reinforcement 5010 between the shells 3010 and 3020 to provide additional rigidity and dimensional stability.

In some embodiments, the lift strap 2040 may be riveted or connected at both ends to the body portion, in order to facilitate easy removal of the insert from the manhole.

In all embodiments, when the sealing means, such as a tube or bladder of rubber or closed cell neoprene, is positioned on or in the rim of the body portion such that, when inflated, the sealing means forms an essentially watertight seal between the insert and the manhole frame to prevent water from seeping down around the edges. In addition, to neoprene and rubber, the sealing means may alternatively be any expandable resilient material including neoprene, rubber, EPDM, PVC, urethane and combinations thereof.

In some embodiments, the manhole sealing insert may be entirely inflatable. In such cases, the entire insert may be formed as an inflatable bladder with stiffening regions formed in a top, bottom or, both surfaces thereof to assist the manhole sealing insert in maintaining its shape.

In all embodiments, around the periphery of the manhole sealing insert is shown an inflatable rubber seal. The inflatable seal is affixed to the edge of the manhole sealing insert. When air pressure is applied, the seal inflates to engage with the wall of the manhole structure. The seal contours to the shape of the manhole wall to create a reliable seal as well as exerting pressure against the wall to assist in retaining the sealing insert in the installed location.

It can therefore be seen that the present disclosure provides a manhole sealing insert that allows easy and reliable installation in an active manhole access port. It can further be seen that the present disclosure provides a manhole sealing insert that can easily be handled to facilitate installation in space restricted environments. Still further it can be seen that the present disclosure provides a manhole sealing insert that can be easily serviced on sit allowing installation and removal to facilitate the servicing of the system and reinstallation for a reliable seal against water infiltration. For these reasons, the present disclosure is believed to represent a significant advancement in the art, which has substantial commercial merit.

Various other components may be included and called upon for providing for aspects of the teachings herein. For example, additional materials, combinations of materials and/or omission of materials may be used to provide for added embodiments that are within the scope of the teachings herein.

In the present application a variety of embodiments are described. It is to be understood that any combination of any of these variables can define an embodiment of the invention. Other combinations of articles, components, conditions, and/or methods can also be specifically selected from among variables listed herein to define other embodiments, as would be apparent to those of ordinary skill in the art.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A manhole cover seal, comprising:

a hollow body formed from an upper rigid shell, a lower rigid shell, spaced apart from said upper rigid shell and at least one stiffening rib extending between said upper and lower rigid shells, said hollow body having a cavity therein, and an outer periphery of said upper and lower rigid shells forming a rim on said body;

an expandable bladder, received in said rim, said expandable bladder in fluid communication with said cavity within said body, wherein said expandable bladder forms a watertight seal against a manhole frame when inflated;

a fill valve in fluid communication with said cavity; and a drain hole positioned within said body to allow for controlled removal of accumulated water from the top of the seal, said drain hole including a gravity-based drain plug, wherein fluid entering said fill valve increases a pressure within said cavity and causes said expandable bladder to expand to seal said manhole.

2. The manhole cover seal of claim 1, wherein said drain plug includes a lifting ring on a top thereof.

3. The manhole cover seal of claim 1, wherein removal of said drain plug allows water trapped on a top surface of said manhole cover seal to drain through said drain hole.

4. The manhole cover seal of claim 1, further comprising:

at least one lifting strap extending from said body.

5. The manhole cover seal of claim 1, further comprising:

a rigid core positioned within at least a portion of said hollow cavity within said body.

6. The manhole cover seal of claim 1, further comprising:

a rigid shell material on a top and bottom of said body portion; and a rigid rim structure joining a periphery of said top and bottom shells, wherein said expandable bladder is affixed around said rigid rim structure.

7. The manhole cover seal of claim 6, wherein said expandable bladder is a tube received and retained in said rigid rim structure.

8. The manhole cover seal of claim 1, wherein said expandable bladder is a resilient material selected from the group consisting of neoprene, rubber, EPDM, PVC, urethane, and combinations thereof.

9. The manhole cover seal of claim 1, wherein said fluid entering said fill valve is selected from the group consisting of: a gas, compressed air, nitrogen, gel, foam, and combinations thereof.

* * * * *